US006971265B1

(12) United States Patent
Sheppard et al.

(10) Patent No.: US 6,971,265 B1
(45) Date of Patent: Dec. 6, 2005

(54) DOWNHOLE SENSING APPARATUS WITH SEPARABLE ELEMENTS

(75) Inventors: Michael Charles Sheppard, Waterbeach (GB); Thomas Harvey Zimmerman, Katy, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 10/049,749

(22) PCT Filed: Jul. 13, 2000

(86) PCT No.: PCT/GB00/02697

§ 371 (c)(1),
(2), (4) Date: Jun. 26, 2002

(87) PCT Pub. No.: WO01/04661

PCT Pub. Date: Jan. 18, 2001

(30) Foreign Application Priority Data

Jul. 14, 1999 (GB) ..... 9916350

(51) Int. Cl.[7] ..... E21B 47/00
(52) U.S. Cl. ..... 73/152.54; 73/152.55; 166/255.1; 175/40
(58) Field of Search ..... 73/866.5, 152.28, 73/152.55, 152.54, 152.33, 152.02; 175/40, 175/50, 44, 48; 166/250.11, 255.1, 250.01

(56) References Cited

U.S. PATENT DOCUMENTS 5,247,835 A * 9/1993 Howell ..... 73/12.01
5,259,452 A 11/1993 Wittrisch ..... 166/250
5,554,822 A * 9/1996 Gilpin et al. ..... 174/52.3
5,955,966 A * 9/1999 Jeffryes et al. ..... 340/853.1
6,241,028 B1 * 6/2001 Bijleveld et al. ..... 175/40
6,411,921 B1 * 6/2002 Schiltz et al. ..... 702/182
6,443,228 B1 * 9/2002 Aronstam et al. ..... 166/250.11

FOREIGN PATENT DOCUMENTS

| | | | | |
|---|---|---|---|---|
| EP | 780702 A1 | | 6/1997 | ..... G01V 1/40 |
| GB | 1 549 307 | | 9/1976 | ..... G06F 3/00 |
| JP | 10006671 A | * | 1/1998 | ..... B24D 15/10 |
| WO | WO98/12418 | | 9/1997 | ..... E21B 47/00 |
| WO | WO99/66172 | | 6/1999 | ..... E21B 47/00 |
| WO | WO 01/426622 A | * | 6/2001 | |
| WO | WO 42622 A1 | * | 6/2001 | |
| WO | WO 200142622 A1 | * | 6/2001 | ..... E21B 23/08 |

OTHER PUBLICATIONS

The Corona Satellite. "The Major COmponents of the Corona Camera System", http://www.nro.odci.gov/corona/sysinfo2.htm, pp. 1-3.

* cited by examiner

*Primary Examiner*—John E. Chapman
*Assistant Examiner*—Nashmiya Fayyaz
(74) *Attorney, Agent, or Firm*—Jody Lynn DeStefanis; William L. Wang; Dale Gaudier

(57) ABSTRACT

A sensing apparatus is provided for use downhole, comprising a housing and sensing means with the housing containing a plurality of separable elements to which data acquired by the sensing means is transferred. The separable elements are releasable from the housing to convey the acquired data to surface. The separable elements have a spherical outer casing of around 1 to 10 cm diameter which surrounds a memory chip. The casing has a sealable aperture so that electrical connection to the chip can be established within the housing.

17 Claims, 2 Drawing Sheets

DOWNHOLE SENSING APPARATUS WITH SEPARABLE ELEMENTS

FIELD OF THE INVENTION

The invention relates to a sensing apparatus particularly suitable for use downhole within oil and gas wells.

BACKGROUND OF THE INVENTION

Gathering of information relating to a well is possible by lowering a logging tool on a wireline into a well. The logging tool acquires data relating to the well characteristics, such as fluid velocity and temperature, and typically transmits the logged data to surface by telemetry along the wireline. However logging tools on wirelines often get caught within the well, leading to problems of acquiring data at desired positions and also retrieval of the tool.

Self-powered robotic logging devices have been developed to avoid the need for use of a wireline. It is relatively easy to get a self-powered robotic device to the bottom of a well because downwards travel of the device involves moving from smaller diameter production tubing to larger diameters at the bottom of the well. However difficulties occur in retrieving such devices because the return journey to the surface involves locating, and passage through, the smaller diameter opening.

It is one aim of the present invention to provide a sensing apparatus which at least in part overcomes the existing difficulties with robotic logging devices.

SUMMARY OF THE INVENTION

In accordance with one aspect of the invention, there is provided sensing apparatus comprising a housing and sensing means, characterised in that the housing contains a plurality of separable elements to which data acquired by the sensing means is transferred, and which are releasable, after data transfer, from the housing.

The separable elements act as passive receptors for data acquired from the sensing means, and in this way, an autonomously powered device can be sent downhole and left in place while data is transferred to the surface over time by sending the separable elements back to the surface, so extending the useful lifetime of the sensing apparatus.

The sensing means may include or be connected to electronic memory means which temporarily stores the acquired data. The stored data can be downloaded to a further memory device in a separable element when required.

Preferably the sensing apparatus comprises actuable port means, openable to release the separable elements.

Preferably the separable elements each comprise a rigid casing, with a sealable aperture, the casing surrounding data storage means, such as a memory chip, in which the acquired data is stored for transfer to the surface. The aperture allows a connection to be made to the data storage means therein so that data can be written thereto. Closure and sealing of the aperture permits watertight sealing of the element to protect the memory chip from wellbore fluids once the separable element is released.

Preferably the aperture is surrounded by a sealing material, typically made of thermosetting plastics material, which can be heat treated within the housing so as to provide a fluid-tight seal which is continuous with the casing surface. This improves the robustness of the separable element.

The separable elements are preferably spherical so as to reduce the likelihood that they will snag on protrusions within the interior of the well. Thus typically each separable element will comprise two hollow metal hemi-spheres, joined by a plastics seal to form a sphere.

Preferably the separable elements are also configured to be either neutrally buoyant, or buoyant, in relation to well fluids, so that they are easily carried to surface.

Generally the separable elements have a diameter in the range of 1 to 10 cm, and more preferably in the range 1 to 5 cm, so that they can easily transfer from downhole large diameter sections to smaller diameter tubing nearer the surface. Typically a large number of separable elements are contained in the housing, of the order of 100–500 elements.

The housing of the sensing apparatus and the casings of the separable elements may be formed from plastics material or metal.

The invention also lies in the provision of separable elements in a downhole sensing apparatus as aforesaid.

In accordance with another aspect of the invention, there is also provided a method of acquiring data from downhole, comprising placing downhole a sensing apparatus containing a number of separable elements and releasing the elements to carry acquired data to the surface as required.

BRIEF DESCRIPTION OF THE DRAWINGS

The invention will now be described by way of example, and with reference to, the accompanying drawings in which.

DETAILED DESCRIPTION OF THE INVENTION

Figure 1:
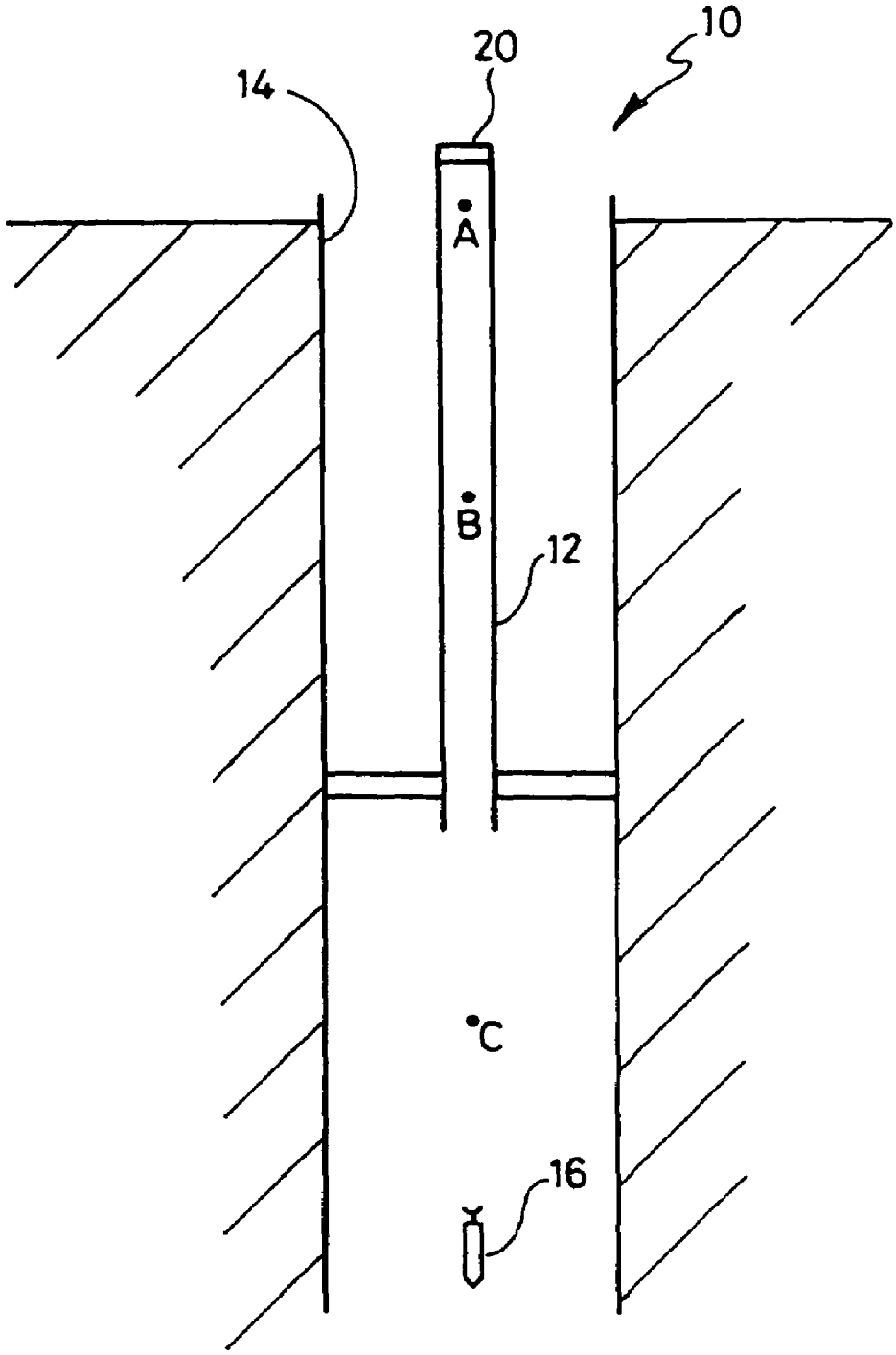
FIG. 1 shows a schematic diagram of a sensing apparatus according to the present invention during travel downhole.

In FIG. 1, a completed well 10 is shown, with production tubing 12 cemented into position centrally within a borehole 14. The production tubing 12 is capped at surface and an autonomous sensing apparatus or tool 16, which has been transferred through a cap 20 to travel downhole under its own power, is shown passing down the wellbore 14 from position A to position B, and thence to beyond position C where it emerges into the completion.

As the tool 16 passes downhole, data is either acquired continuously by the tool 16 or acquired at fixed depths along the wellbore 14, with the tool 16 measuring various characteristics including pressure, temperature, flow rate and chemical species. These measurements are referenced to the position in the completion either by counting casing collars and using existing knowledge of the location of perforation sites within the walls of the completion, or by integrating the velocity of the tool as derived from on-board sensors.

The velocity of the tool 16 is typically sensed by including a pair of sonic source/sensor packages or a pair of infra red source/sensor packages to sample the borehole wall and configure such that cross-correlation of the source/receiver pair will provide velocity of the tool.

Figure 2:
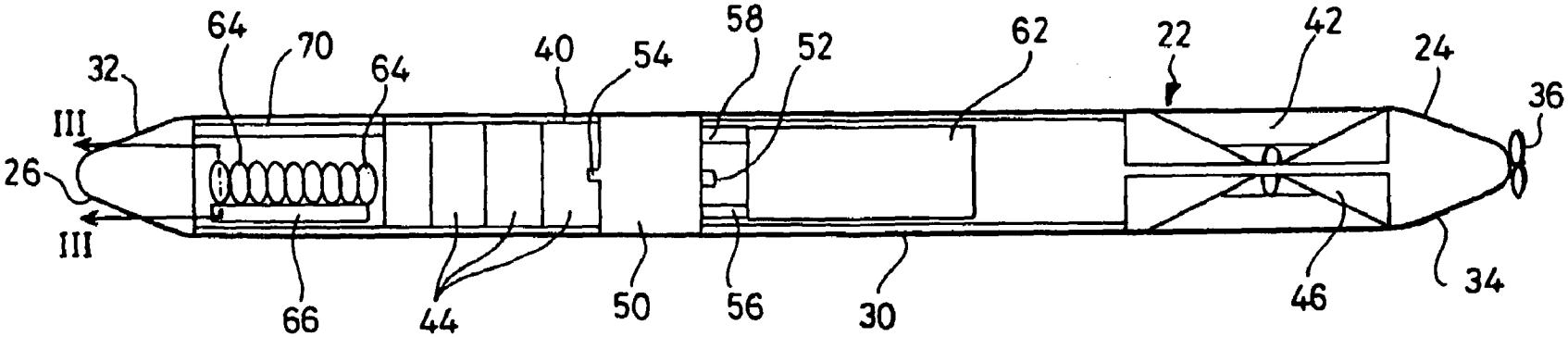
FIG. 2 shows a cross-section of the sensing apparatus.

The sensing apparatus 16 is shown in cross-section in FIG. 2. This robotic device has a body 22 with a total length of around 2.1 m and is generally comprised of three sections, a rear 24, a front 26 and a middle section 30. The middle section 30 is a hollow cylindrical metal casing of diameter 0.114 m which contains and surrounds components carried by the device 16. Attached to each end of the middle section 30 are respective cone sections 32, 34 which are truncated with a hemi-spherical surface to improve the aerodynamic structure of the device.

The first cone 32 forms a front nose of the device 16, with the second cone 34 attached to the rear of the casing carrying a propeller 36. To strengthen the device 16, an internal carbon fibre wall 40 formed as a hollow cylinder around 7 mm wall thickness is inserted into the middle section 30 to improve rigidity and robustness of the device 16, and also to protect components contained within the middle section when downhole. The carbon fibre wall 40 thus encases active sensing and data storage components which are contained within the device 16, and the wall 40 is generally provided with a number of individual compartments so that different parts of the middle section 30 can be sealed with respect to other compartments.

Towards the rear end of the middle section 30, a motor 42 is provided which is attached to the propeller 36 carried on the second cone 34. The motor 42 and other electrical components within the device are powered by three batteries 44 arranged in series, and the motor 42 turns the propeller 36 to drive the device 16 downhole. Where the motor 42 and propeller 36 are attached, shaft seals 46 are used to ensure that the rear end of the middle section is sealed against external fluid.

A ballast holder 50 is placed centrally of the middle section 30, and an appropriate amount of ballast introduced into this container so that the tool 16 is neutrally buoyant, i.e. it neither sinks nor rises within the fluid downhole. This ensures that the tool 16 can be powered through the produced fluids by the motor 42 and associated propeller 36. A variety of sensors 52, 54, 56, 58 are included within the body of the device 16 to sense various parameters downhole including pressure, temperature, flow rate, chemical species, magnetic flux and fluid composition. The data provided by the sensors 52, 54, 56, 58 is stored in data acquisition and control board 62 which, like the motor 42, is powered by the three batteries 44.

Towards the front end of the middle section, a large number of releasable elements 64, or memory fish, are contained in a front compartment 68 which is sealed from the remainder of the device. The compartment need not be sealed hermetically. The releasable elements 64 are carried on and detachably connected to a bus 66 which is in electrical communication with the data acquisition and control board 62. The front compartment 68 is provided with a flap 70 in its external wall, which whilst normally closed, opens to allow release of selected fish in response to a command from the control board 62. The control board 62 is pre-programmed at surface before the device 16 goes downhole with a program which instructs release of the elements 64 in a chosen manner, typically to release a small number of fish at spaced apart intervals of time over a few years.

Figure 3:
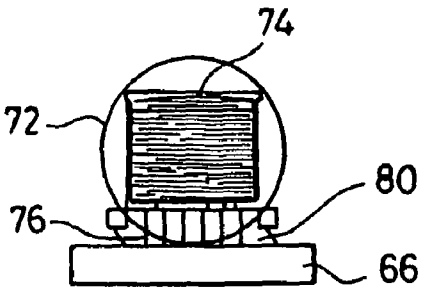
FIG. 3 shows a section along line III—III of FIG. 2.

Each fish 64 comprises a hollow sphere 72 of around 3 to 5 cm diameter made substantially of metal and which encases a memory chip 74 to which data can be downloaded via bus 66 from the data acquisition and control board 62. The sphere 72 has an aperture 76 surrounded by heat-sealable material, such as thermosetting plastics material, so that the fish is a completely sealed device. Electrodes 80 on the bus 66 communicate with the memory chip 74 of each fish 64 either inductively or by any other indirect means such as infra-red, or by direct combat through electrical pin conductors attached to the electrodes 80 protruding into the sphere through the aperture as shown in FIG. 3 so as to establish an electrical connection with the chip. Additionally, the data can be encrypted prior to being transferred to the fish. For example, the encryption could be carried out on data acquisition and control board 62, and the encrypted data could be transmitted to memory chips 74 as described.

When a fish is ready for release, it is mechanically raised from the location where it mates with the electrodes 80 so as to separate it from the electrodes on the bus. The opening where the electrodes connected with the chip is sealed by use of a heating element on the sealable material so as to form a substantially smooth water-tight sphere, and then the fish is released. The smooth sealed sphere is robust and resistant to ingress of fluid.

The fish 64 are essentially chips embedded in low density plastics material and can be as small as 1 cm2, or less, and larger if necessary.

The robotic device 16 can carry up to hundreds of small memory fish 64, which are either neutrally buoyant or partially buoyant and after each set of measurements instructed via the control board 62, the board downloads the collected data to a chosen number of fish 64, and then instructs separation of the selected fish from the bus 66, sealing of the spheres 74 ready for release, and then opening of flap 70 to release the spheres 74. The fish released into the fluid flowing in the well are swept upwards and are then retrieved at surface. Retrieval of the fish at surface can be assisted by selecting the size and shape of the plastics body 72 of the fish. Typically the same data is written to more than one fish so that the chances of retrieval of the data are maximised. If the data in the fish had been encrypted, the data will then be decrypted after retrieval.

Before release of the memory fish 64 into the flow, the tool 16 is programmed to send an acoustic signal by using a transducer, the acoustic signal travelling to surface either via the fluid or the tubulars, so as to alert crew at surface that the release is about to take place and that steps should be taken to retrieve the memory fish. Alternatively the fish may be released at a pre-determined time.

By using the memory fish 64, a robotic production logging device which has been sent to the bottom of a well can lie within the well over a period of time whilst still providing measurements that can be sent to surface via the fish. By providing a large number of memory fish, typically 300–500, within the sensing apparatus and releasing these at selected intervals, the well can be monitored over, for example, 3 to 5 years.

With a robotic logging device, it is much easier to send the device to the bottom of a well than it is to get it to travel back to surface. This is largely because of the geometry of the tubulars used to encase the internal wall of the well structure as when the robotic device travels from position A to position C, for example, the device moves from smaller diameter tubes of the production tubing to larger tubes of the completion. For the robotic device to travel back to surface, it must travel from a larger diameter tube into a smaller opening, which involves difficulties with locating and entering the smaller tubing. The present invention allows the logging device to remain downhole, whilst still permitting logged data to reach the surface by using the small passive data receptors to carry data to surface by being carried up within the fluid to the surface.

The tool can thus sample the well over depth and over periods of time to provide information about the evolution of the downhole flow and fluid character, both of a chemical and physical nature. The device provides a simple production logging tool which avoids well intervention and ensures that wells can be logged cheaply when a convention approach would be too costly.

The sensing apparatus does not necessarily need to be an autonomously powered device, but could be provided either on wireline or even within the casing used to complete the well.

While preferred embodiments of the invention have been described, the descriptions are merely illustrative and are not intended to limit the present invention.

What is claimed is:

1. A system for making measurements in a wellbore and communicating data representing the measurements out of the wellbore comprising:

a sensor for making measurements in the wellbore; and a housing comprising a plurality of separable passive data receptors to which data acquired by the sensor is transferred, said data receptors being released in the wellbore, after data transfer, from the housing.

2. A system according to claim 1, wherein the sensor is electrically connected to an electronic memory within each of said plurality of separable passive data receptors which stores the acquired data, the electrical connection being broken prior to or during release of each of said Plurality of separable passive data receptors from the housing.

3. A system according to claim 1, wherein the system further comprises an actuable port, openable to release the separable passive data receptors.

4. A system according to claim 2, wherein each of said plurality of separable passive data receptors comprises a rigid casing with a sealable aperture, the casing surrounding each electronic memory and each electrical connection passing through the sealable aperture.

5. A system according to claim 4, wherein the sealable aperture of each rigid casing is formed by an aperture surrounded by a sealing material, with the sealing material being heat treatable within the housing so as to provide after the electrical connection is broken a fluid-tight seal which is continuous with the surface of each rigid casing.

6. A system according to claim 1, wherein the passive data receptors are spherical.

7. A system according to claim 6, wherein each passive data receptor comprises two hollow metal hemispheres, joined by a plastics seal to form a sphere.

8. A system according to claim 1, wherein the housing and outer casings of the passive data receptors are formed from plastics material or metal.

9. A system according to claim 1, wherein the passive data receptors are configured to be either neutrally buoyant or buoyant, in relation to fluids within the wellbore.

10. A system according to claim 1, wherein the passive data receptors have a diameter in the range of 1 to 10 cm.

11. A system according to claim 1, wherein the passive data receptors have a diameter in the range 1 to 5 cm.

12. A system according to claim 1, wherein the data is encrypted prior to transfer to the passive data receptors.

13. A method of acquiring data from downhole, comprising the steps of:

placing downhole a system comprising a sensor and a number of separable passive data receptors;

making measurements using the sensor;

transferring data representing the measurements to the passive data receptors; and releasing the passive data receptors to carry the data from downhole to the surface.

14. A system according to claim 1 wherein the sensor is located within the housing and the sensor is adapted make measurements while the housing descends into the wellbore.

15. A system according to claim 14 wherein the housing is a robotic logging device.

16. A system according to claim 15 wherein the robotic logging device is autonomously powered.

17. A system according to claim 14 wherein the housing is attached to a wireline.

* * * * *